US007183248B2

(12) United States Patent
Manning, Jr.

(10) Patent No.: US 7,183,248 B2
(45) Date of Patent: Feb. 27, 2007

(54) ENZYMATIC CLEANER HAVING HIGH PH STABILITY

(75) Inventor: James T. Manning, Jr., Wilson, NC (US)

(73) Assignee: Treyco Supply Co., Wilson, NC (US)

( * ) Notice: Subject to any disclaimer, the term of this patent is extended or adjusted under 35 U.S.C. 154(b) by 555 days.

(21) Appl. No.: 10/223,651

(22) Filed: Aug. 20, 2002

(65) Prior Publication Data

US 2003/0089381 A1 May 15, 2003

(51) Int. Cl.
*C11D 3/386* (2006.01)
*C11D 3/395* (2006.01)
*C11D 7/54* (2006.01)

(52) U.S. Cl. ..... 510/393; 510/392; 510/397

(58) Field of Classification Search ..... 510/392, 510/397, 393, 365
See application file for complete search history.

(56) References Cited

U.S. PATENT DOCUMENTS 4,655,794 A * 4/1987 Richardson et al. ..... 510/393
5,525,255 A * 6/1996 Leadingham et al. ..... 510/365
5,863,882 A * 1/1999 Lin et al. ..... 510/397
6,624,133 B1 * 9/2003 McKenzie et al. ..... 510/392

FOREIGN PATENT DOCUMENTS

WO WO 00/29535 * 5/2000

* cited by examiner

*Primary Examiner*—Douglas McGinty
*Assistant Examiner*—Preeti Kumar
(74) *Attorney, Agent, or Firm*—Isaac A. Angres

(57) ABSTRACT

The present invention is directed to a cleaning composition comprising: (a) an enzyme in an amount effective to promote cleaning; (b) viable microorganisms in an amount effective to degrade and promote the degradation of organic materials; (c) a surfactant; and (d) an aqueous carrier; said cleaning composition maintaining at least 95% enzymatic activity at a pH range of from about 5.5 to about 13.5.

4 Claims, 11 Drawing Sheets

ENZYMATIC CLEANER HAVING HIGH PH STABILITY

FIELD OF THE INVENTION

This invention relates to improved enzymatic cleaners for use in industrial and non-industrial cleaning applications. The invention also provides novel formulations or compositions which are suitable for cleaning and sanitizing bathroom fixtures, sinks, toilet bowls, and other dirty and contaminated surfaces. This invention provides a "Green Chemistry" cleaner based on the "Twelve Principles of Green Chemistry". This invention further relates to a non corrosive, non irritating, alkaline enzymatic cleaning compositions incorporating viable microorganisms and having stability at high pH and high temperatures. The present invention also relates to compositions and methods for cleaning and de-oiling metal parts and the like replacing the existing hydrocarbon solvent cleaners by using enzymes. More specifically, this invention relates to environmentally-friendly, aqueous-based compositions and methods for cleaning and de-oiling metal parts and the like using enzymes to digest organic compounds on or removed from the metal parts. This invention also relates to environmentally-friendly, aqueous-based cleaning compositions containing specific surfactants, enzymes and viable microorganisms to remove and degrade organic compounds, including oil, petroleum, petroleum products, and the like, from metal parts and methods using such compositions. The instant invention also provides an enzymatic multipurpose cleaning heavy-duty composition useful for removing wax, tar, oil, grease, soap film, iron deposits, surface stains, dirt, removal of any type of stain from any tile surface, textile fabric, carpet, terrazzo, slate, wood, metal, concrete, aluminum, porcelain, marble, rubber, jewelry, gas nozzle, shower glass, carburetors, engine parts, etc. This invention is also directed to novel enzymatic formulations or compositions which are suitable for cleaning and sanitizing bathroom fixtures, sinks, toilet bowls, and other dirty and contaminated surfaces such as concrete surfaces, carpets and other surface wherein dirt and or non-desirable deposits may accumulate. The present invention further relates to non corrosive, non irratiating alkaline enzymatic compositions having high pH stability comprising one or more enzymes, viable microroganisms and one or more surfactants, useful in the cleaning of industrial and non-industrial equipment. The present invention further relates to novel cleaning methods using surfactants, viable microorganisms and enzymes at high pHs' to remove oil, grease and other hydrophobic and/or industrial wastes from various surfaces. One method involves cleaning the surface by contacting it with a composition comprising one or more enzymes, one or more viable microorganisms and one or more surfactants.

The present invention also relates to a method for cleaning articles and surfaces contaminated with organic or lipophilic wastes. More particularly, the present invention further relates to a method for cleaning industrial and domestic surfaces and articles and for enhancing the biodegredation of biodegradable organic or lipophilic wastes by applying the cleaning compositions of the instant invention.

BACKGROUND OF THE INVENTION

The use of enzymes in the cleaning and landering industry has been known for many years and commercial concerns continue to develop more active and useful enzymes. Particularly useful enzymes that are used in the laundering and cleaning industries are proteolytic enzymes, lipolytic enzymes and amylolytic enzymes. The desirability of using proteolytic, α-amylolytic and lipolytic enzymes in cleaning compositions is well known. These enzymes are useful for their ability to reduce macromolecules such as proteins, starches and fats into smaller molecules so that they can be readily washed away by detergents and/or water. Specifically, the proteolytic enzymes are useful in breaking down proteins, the α-amylolytic enzymes are useful in breaking down carbohydrates and the lipolytic enzymes are useful in breaking down fats. Detergent compositions containing these enzymes have a wide variety of uses in that they care capable of removing proteinaceous, starchy and fatty stains such as egg stains, blood stains, gravy stains and the like.

Also, liquid detergents are desirable alternatives to dry, granular detergent products. While dry, granular detergents have found wide consumer acceptance, liquid products can be adapted to a wide variety of uses. For example, liquid products can be directly applied to stains and dirty spots on fabrics, without being predissolved in water or other fluid media. Further, a "stream" of liquid detergent can be more easily directed to a targeted location in the wash water or clothing than a dry, granular product. There have been many attempts to formulate liquid, aqueous detergents which include enzymes. Enzymes are very desirable adjuncts in liquid detergents since they are effective at removing stains which may not be cleaned through detergent or oxidative action. These problematic stains include grass stains, fat stains, oil stains, and blood stains, which typically are complex mixtures of various substances such as proteins, fats, and natural coloring agents.

The use of proteases in heavy duty liquid cleaning formulations is complicated by their limited stability in solution. Two processes which limit the shelf-life of a protease in an aqueous liquid detergent are denaturation and autolysis (self-digestion). Considerable efforts have been devoted to the stabilization of enzymes in aqueous liquid detergent compositions, which represent a medium that is problematical for the preservation of enzyme activity during storage and distribution. Denaturation of proteases may be minimized by selection of optimal formulation components such as actives, builders, etc., and conditions such as pH, so that acceptable enzyme stability is achieved. Self-digestion of proteases may be minimized by inclusion of a protease inhibitor. The inhibitor is released from the enzyme upon dilution in the wash and the proteolytic activity is restored.

It is also known that equipment used in numerous industries comes into contact with various contaminants, which can impede the operation of the equipment and otherwise interfere with production. This effects nearly every industry, including, for example, the chemical processing industry, the oil refinery industry, the pulp and paper industry, the glass manufacturing industry, the general manufacturing industry, and the food and beverage industry. Numerous ferrous and non-ferrous metal surfaces, glass mold surfaces, glass surfaces, as well as plastic surfaces, can similarly become contaminated with oils, greases and other hydrophobic contaminants, as well as inorganic contaminants such as soil. These contaminants are often difficult and expensive to remove using conventional cleaning products and methods. A cleaning step is also routinely included in metal and plastic surface finishing. Typically, these surfaces are cleaned before phosphatizing, rust proofing, painting and the like is done to the surface. It is therefore useful to find cleaning compositions which would address all of the above industries.

The prior art is silent regarding cleaning composition comprising at least one surfactant, one or more viable microorganisms and at least one enzyme and having high stability at high pH as taught by the present invention. There is a long felt need, therefore, for cleaning compositions and methods that are efficient, cost effective, biodegradable and otherwise friendly to the environment. Also, there is a continuing need, therefore, for liquid detergents which contain enzymes which are stabilized and exhibit a greater activity over time.

OBJECTS OF THE INVENTION

With the foregoing in mind, it is an important object of the present invention to provide an enzymatic cleaning composition containing viable microorganisms and having high activity at high pH.

It is another object of the present invention to provide enzymatic cleaning compositions useful for cleaning metal parts.

A further object of the present invention is a method for cleaning metal parts with the compositions of the present invention.

It is a further object of the present invention to provide a method for cleaning gasoline pump nozzles with the compositions of the instant invention.

It is still an object of the invention to provide enzymatic cleaning compositions which incorporate viable microorganisms which are useful for cleaning glass molds and glass manufacturing equipment.

It is another object of the invention to provide methods for cleaning concrete surfaces with the compositions of the present invention.

It is an additional object of the invention to provide an enzymatic cleaner containing viable microorganisms useful for cleaning hydrocarbon contaminated parts and surfaces.

It is yet another object of the invention to provide a method for cleaning industrial parts at alkaline pH using compositions containing enzymes and viable microroganisms.

It is still a further object of the invention to provide unique enzymatic compositions containing viable microrganisms which have high activity at pH greater than 8.5 and at high temperatures.

SUMMARY OF THE INVENTION

Figure 1:
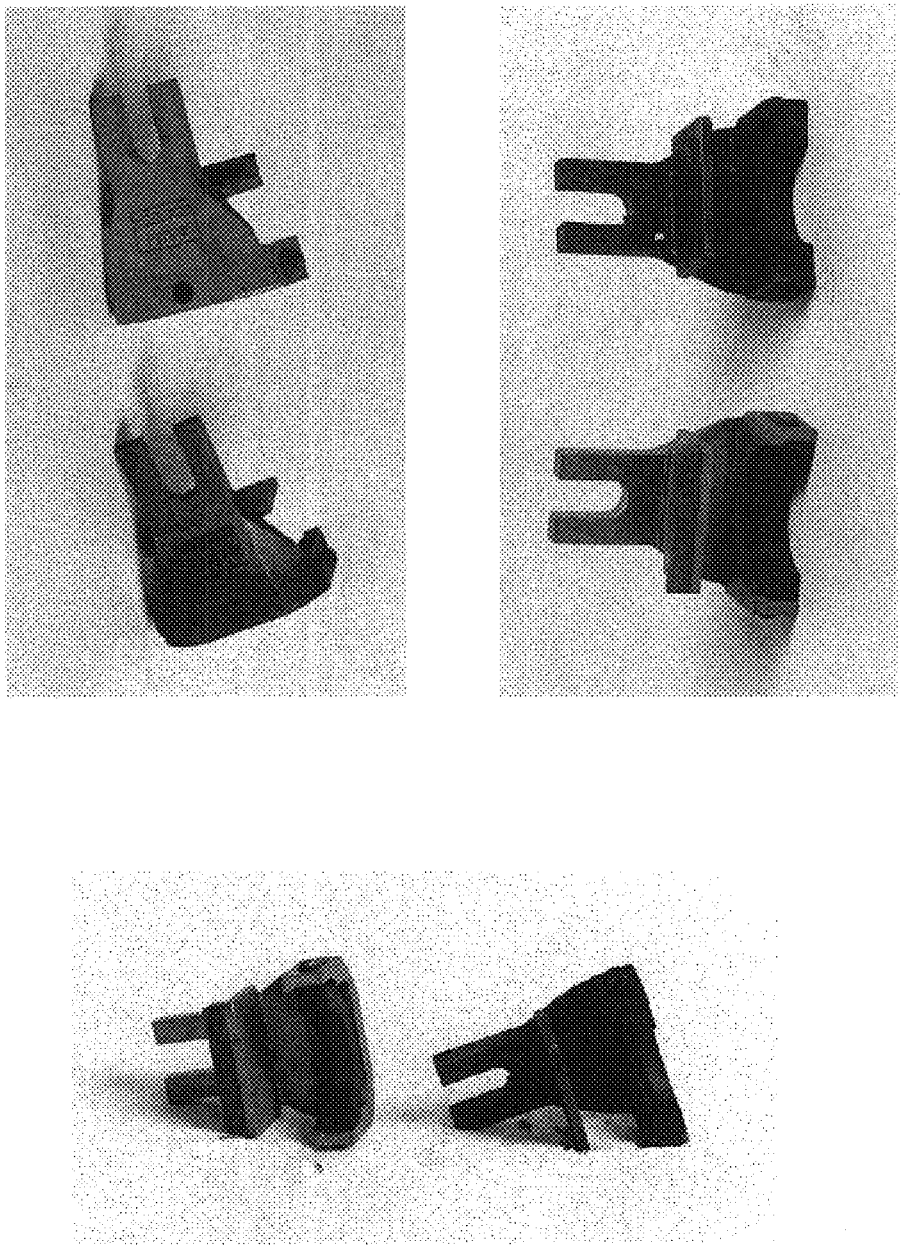
FIG. 1 shows take out tongs for hot glass before and after soaking for 24 hours with the cleaner of the invention.
Figure 2:
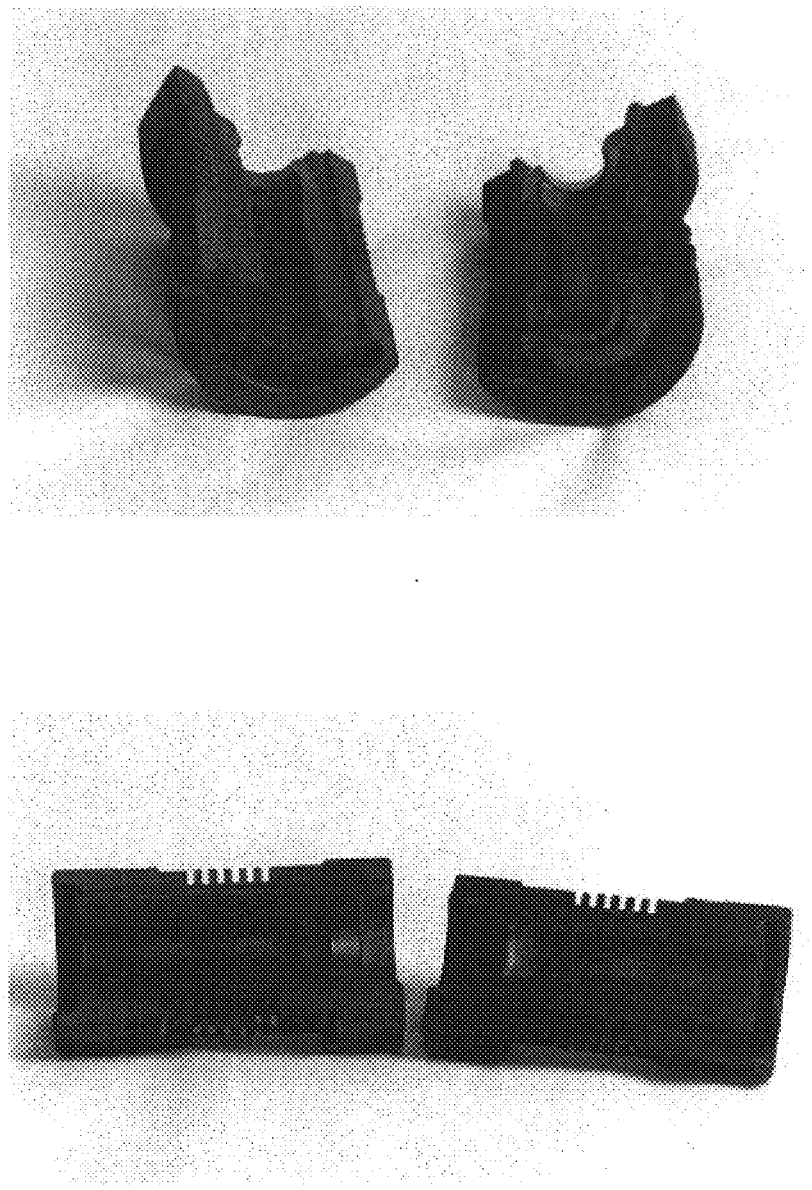
FIG. 2 describes parison blanks (glass molds) before and after soaking for 24 hours with the cleaner of the instant invention.
Figure 3:
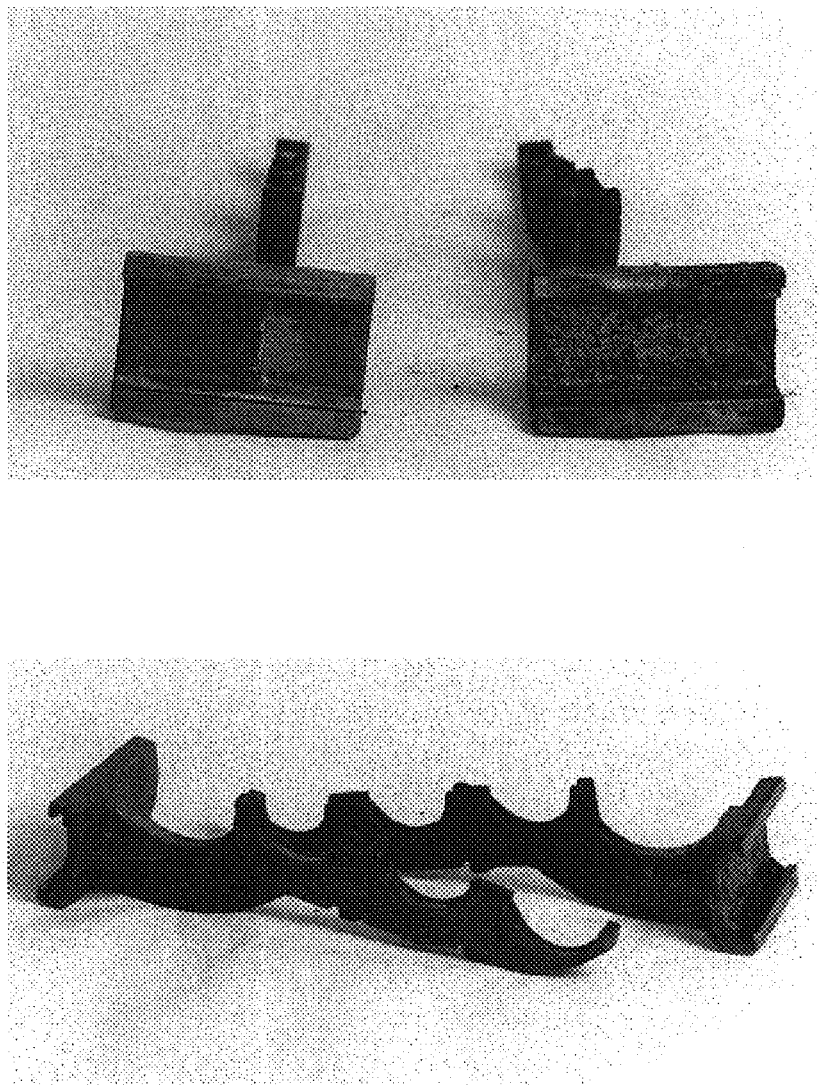
FIG. 3 illustrates the invert arms used in glass production before and after soaking for 24 hours with the cleaner of the invention.
Figure 4:
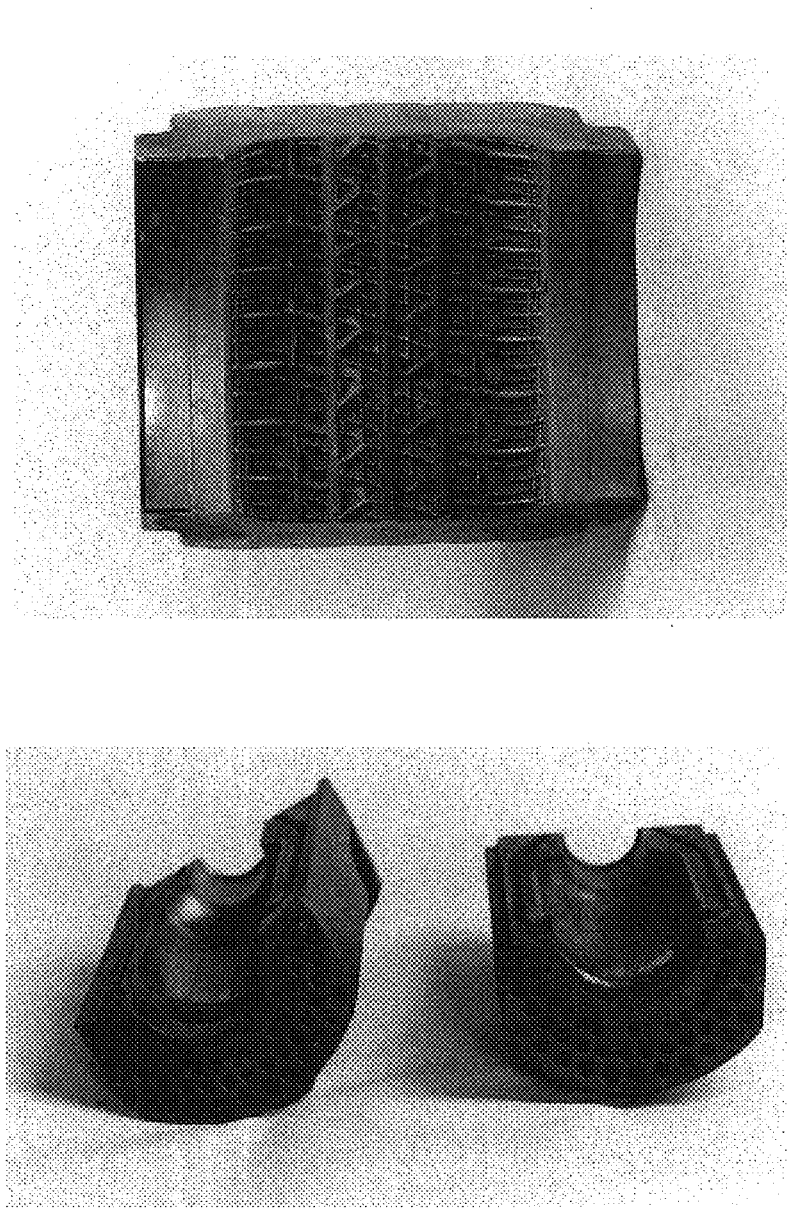
FIG. 4 shows a tire mold before and after soaking for 48 hours with the instant cleaner.
Figure 5:
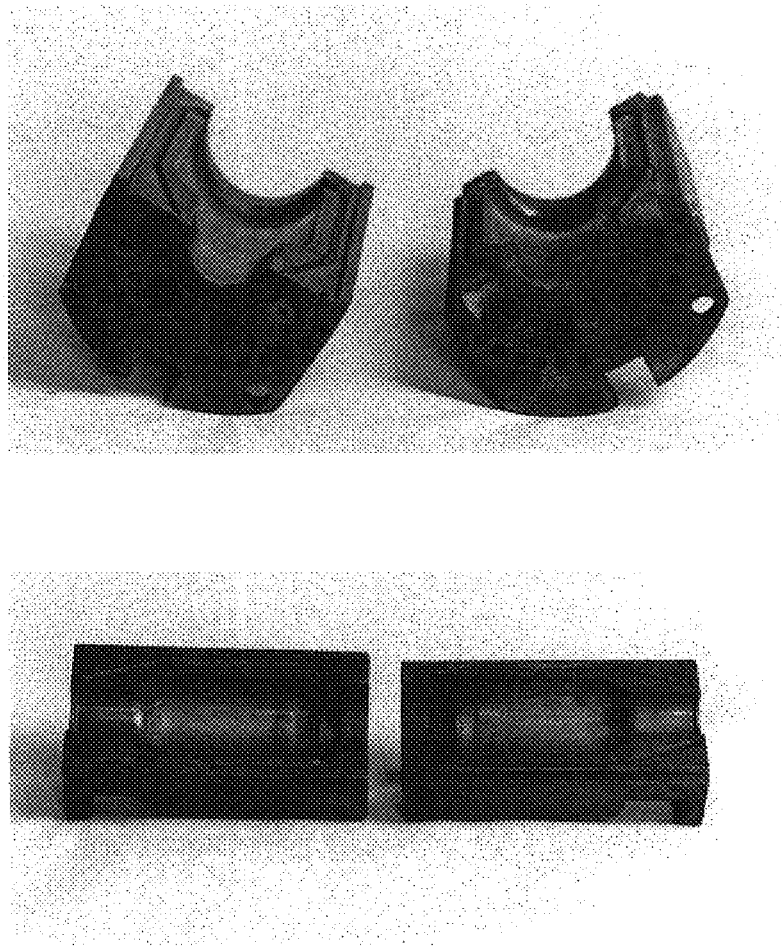
FIG. 5 describes bronze aloe glass molds before and after soaking for 24 hours with the cleaner of the invention.
Figure 6:
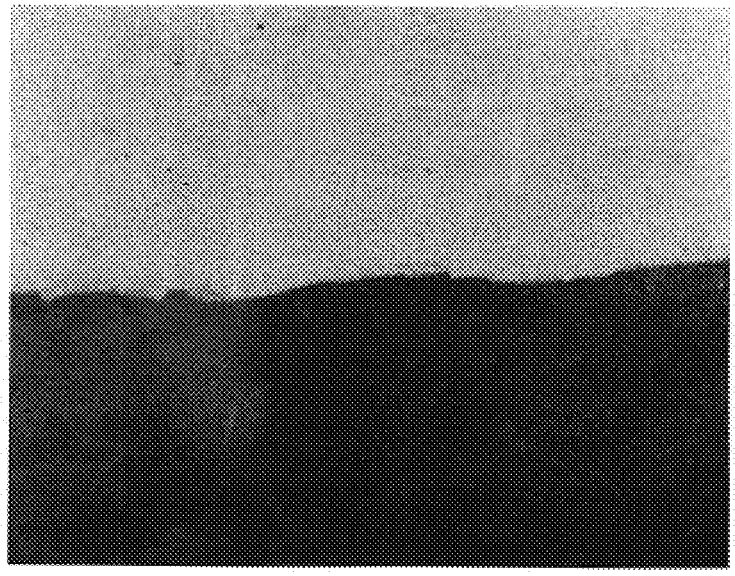
FIG. 6 illustrates a concrete surface before and after exposure for 15 minutes with the cleaner of the invention.
Figure 7:
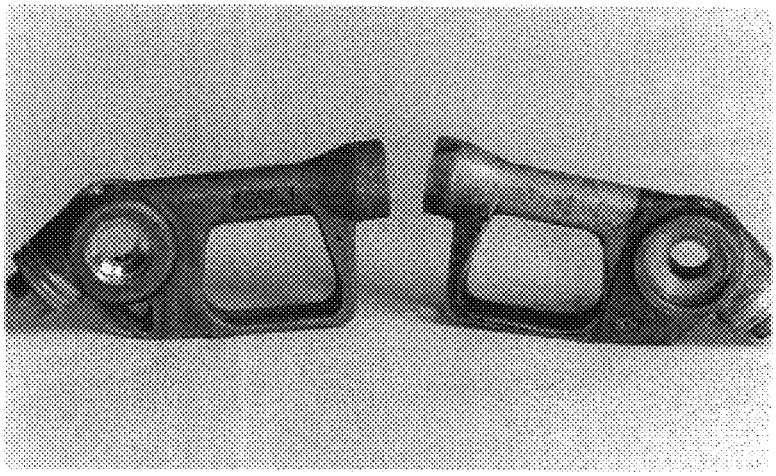
FIG. 7 shows gas nozzles before and after exposure for 20 minutes with the cleaner of the instant invention.
Figure 8:
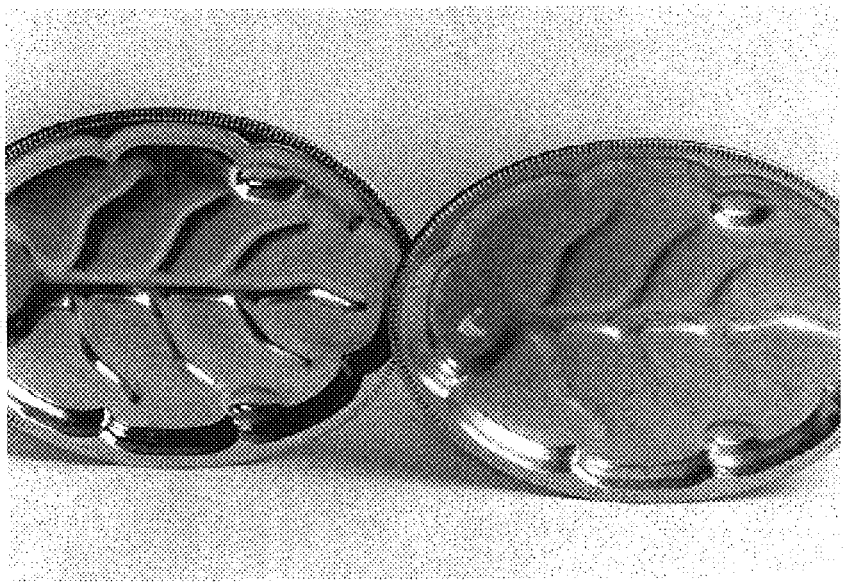
FIG. 8 features serving trays before and after exposure for 30 minutes with the instant cleaner.
Figure 9:
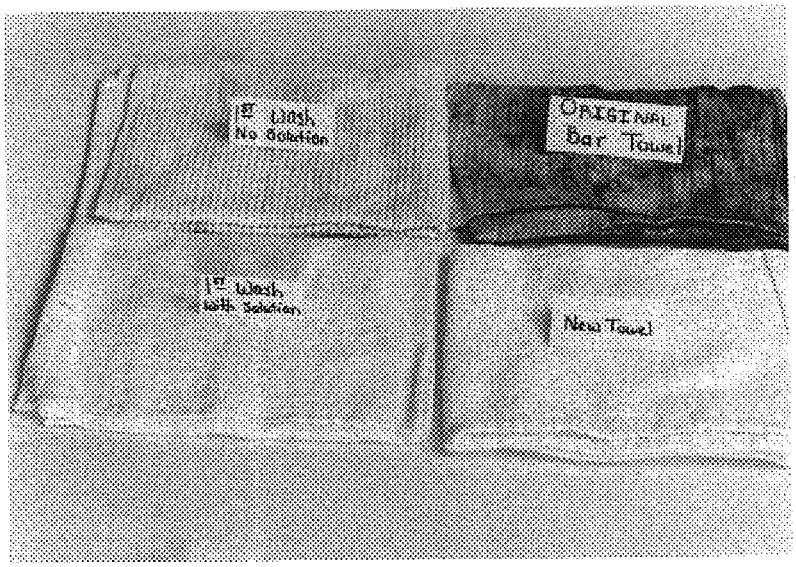
FIG. 9 describes bar towels before and after a regular wash cycle with the cleaner of the invention.
Figure 9:
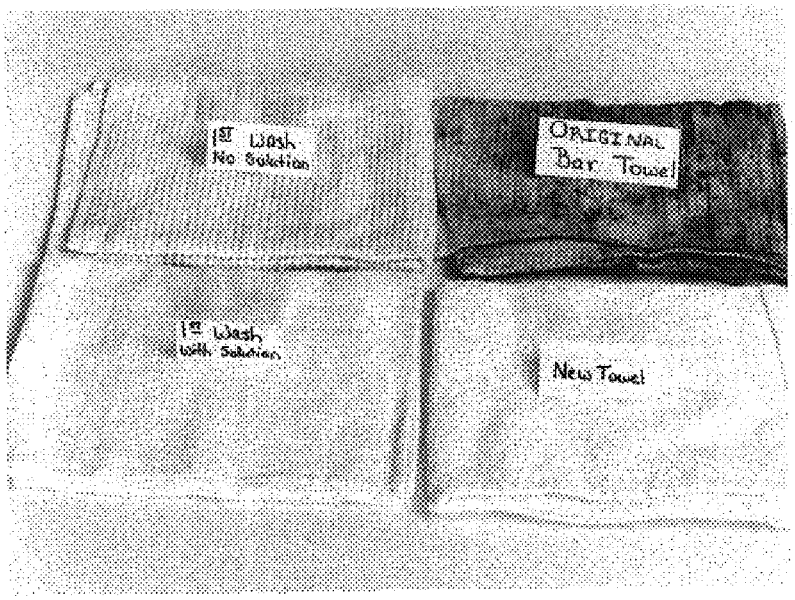
Figure 10:
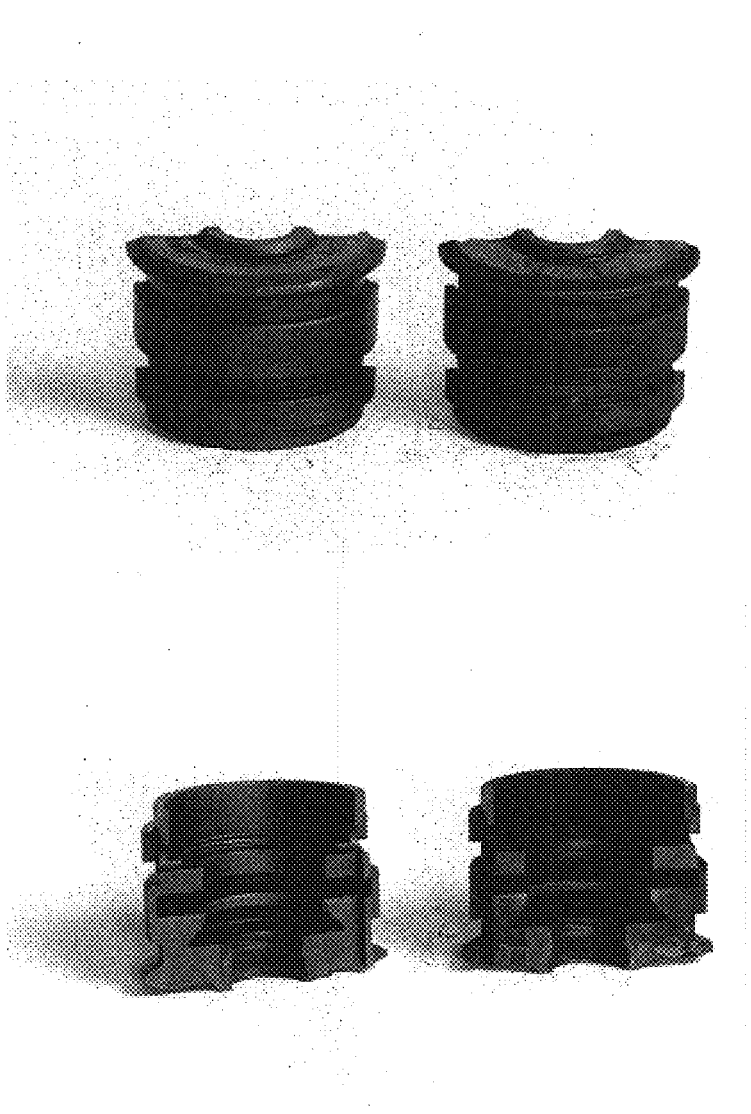
FIG. 10 illustrates bronze neck rings used in glass production before and after 24 hours of soaking with the cleaner of the invention.
Figure 11:
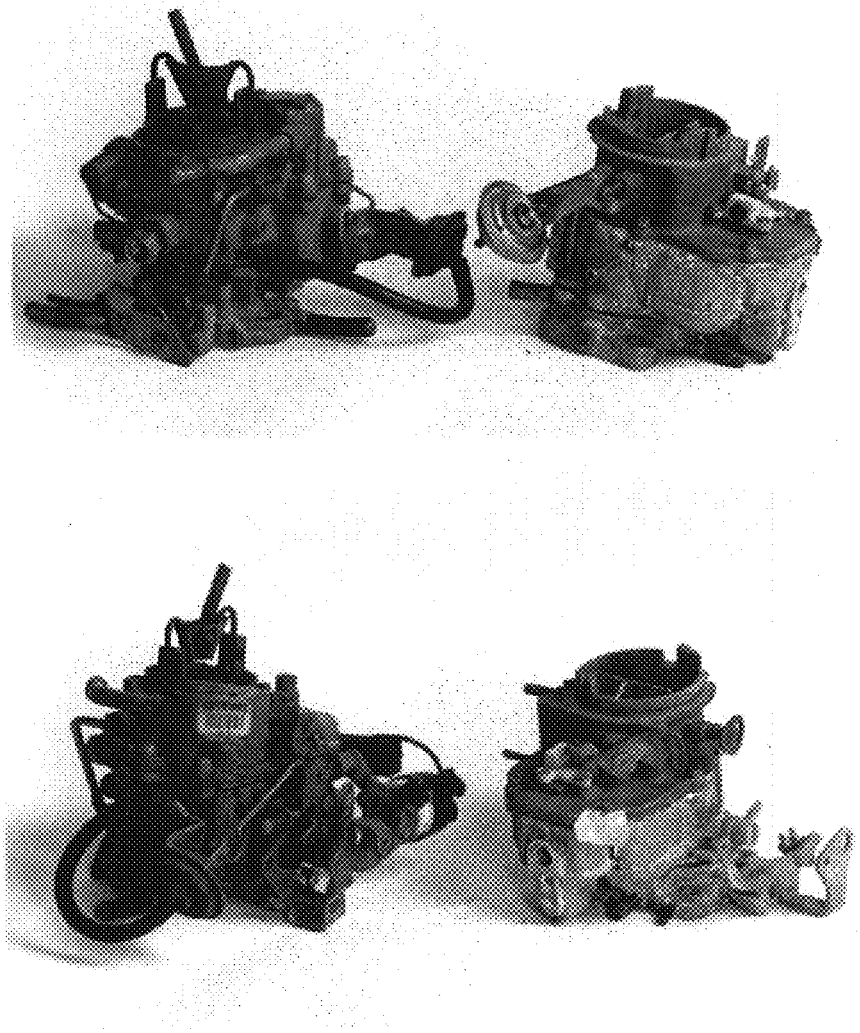
FIG. 11 shows a 30 year old carburetor before and after soaking for 24 hours with the instant cleaner.
Figure 12:
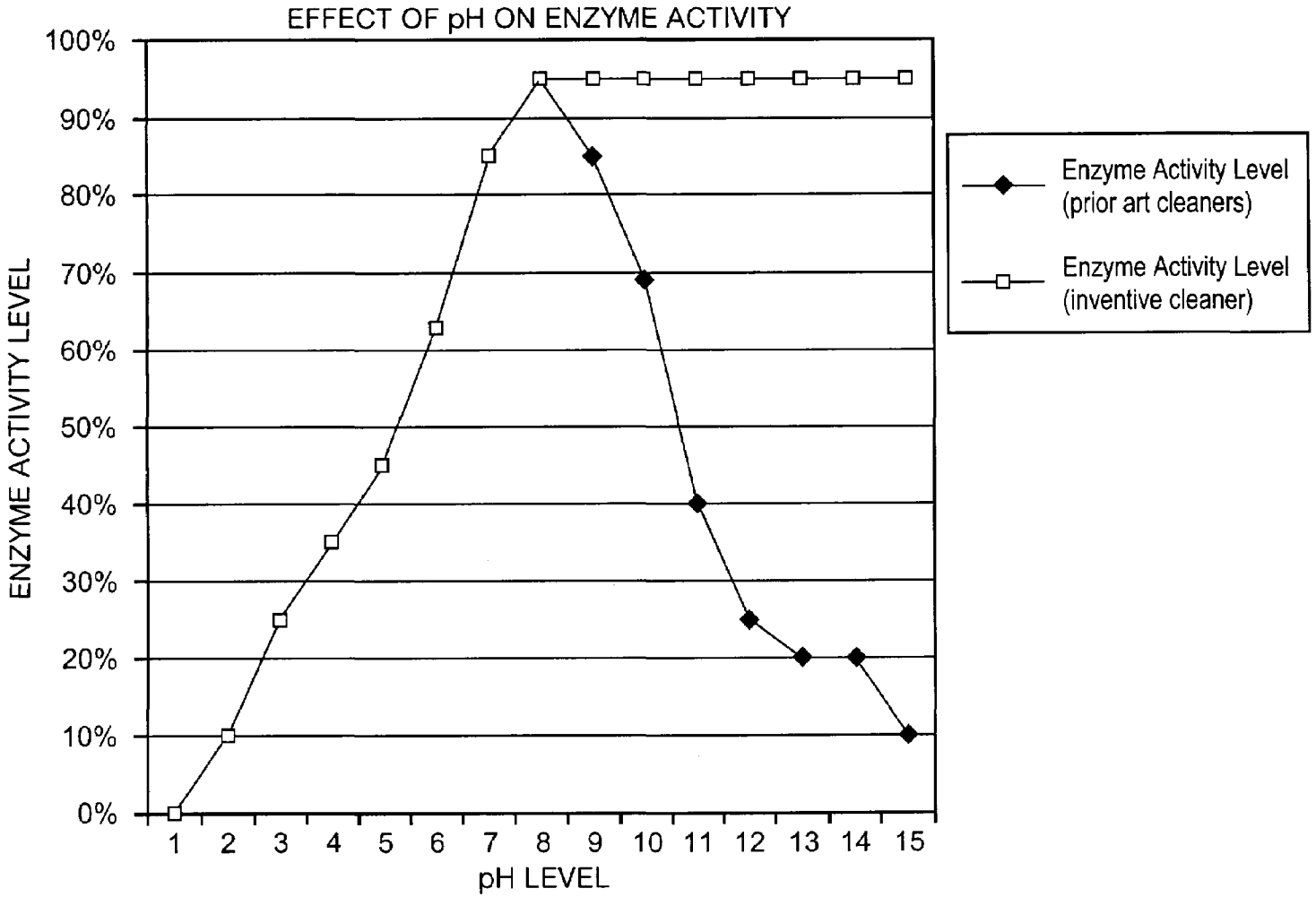
FIG. 12 illustrates the enzyme activity as a function of pH for the cleaner of the instant invention.

The instant invention is directed to a cleaning composition comprising: (a) an enzyme in an amount effective to promote cleaning; (b) viable microorganisms to multiply in numbers, to produce specific enzymes of said micoorganisms and in an amount effective to degrade and promote the degradation of organic materials; (c) a surfactant; and (d) an aqueous carrier; said cleaning composition having at least 95% enzymatic activity at a pH range of from about 5.5 to about 13.5.

The present invention is also directed to a method for cleaning metal parts, glass parts, ceramic parts, or plastic parts having a hard surface, comprising the steps of: (a) treating said metal part with a cleaning composition comprising: (i) at least one enzyme; (ii) at least one viable microorganism; and (iii) a surfactant; wherein said cleaning composition has at least 95% enzymatic activity at a pH range of from about 5.5 to about 13.5; (b) removing residual cleaning composition by treatment with a rinsing agent; and (c) optionally drying said part to completely remove said rinsing agent from the part.

The invention is also directed to a cleaning composition comprising: 5 to 25% by weight of a nonionic surfactant; 1 to 10% by weight of an enzyme selected from the group consisting of proteases, amylases, lipases, cellulases, and mixtures thereof; 1 to 5% by weight sodium silicate; 1 to 7% by weight sodium hydroxide or amounts effective to achieve a pH higher than 7; $1\times10^6$/ml–$1\times10^9$/ml microorganisms; 0.05–2% by weight of a fragrance and the balance water.

DETAILED DESCRIPTION OF THE PREFERRED EMBODIMENTS

The objects of the present invention and many of the expected advantages of the present invention will be readily appreciated as the same becomes better understood by reference to the following detailed description. The compositions of the invention are particularly useful for difficult-to-remove soils, the most severe of which is the baked and/or burned-on (especially when reheated and/or allowed to build up over time). Soil categories include grease, meat (including skin), dairy, fruit pie filling, carbohydrate, and starch. Soiled substrate categories include aluminum, iron, stainless steel, enamel, Corningware, Pyrex, and other glass cookware.

The novel compositions of the present invention contain three essential components and optional components. The essential components are: enzymes, viable microroganisms and a surfactant. The optional components are pH adjusters such as acid, bases or buffer solutions. Other optional ingredients include antimicrobial agents, preservatives coloring dyes as well as other ingredients which may enhance the effectiveness of the cleaning composition.

The specific enzymes that are incorporated in the compositions of the present invention can be proteolytic, amylolytic, lipolytic and cellulolytic enzymes as well as mixtures thereof. Particularly suitable enzymes are alkaline proteases obtained from strains of Bacillus, having maximum activity throughout the pH range from 7.0 to 14.0. The enzymes can be incorporated in any suitable form, i.e., as granulates, marumes, prills, etc., but are more conveniently added to liquid detergents in a fluid form such as in a liquid or slurry. Examples of proteolytic enzymes suitable for use in this invention are sold under the names Alcalase™, Savinase™ and Esperase™ by Novo Industries, Copenhagen, Denmark and Maxatase™ and Maxacal™ by International Biosynthetics, Rijswijk, Netherlands. Properase L, and Purafect OX 4000 L by Genencor International Inc. The preferred enzymes are Savinase™, Maxacal™, and Alcalase™.

The amount of enzyme present in the liquid composition will depend on the concentration of active enzyme in the specific product but will in general be at a level from about 0.001% to about 10% by weight. A preferred system would employ an alkaline protease, optionally in combination with an α-amylase at a total enzyme level from about 0.05% to about 5% by weight of total formula. The activity of the enzyme in the present liquid composition is preferably from 0.001 kilo Novo Protease Units (KNPU) to 1 KNPU per gram of product. One Novo Protease Unit is the amount of enzyme which hydrolyzes dimethyl casein to peptides (as determined by reaction of primary amino groups with trinitrobenzene sulfonic acid at an initial rate that corresponds to 1 micromole of glycine/minute at 50° C. and a pH of 8.3). 3 KNPU are roughly equal to 1 Anson unit. One KNPU roughly corresponds to 80,000 Alkaline Delft Units. A protease as used herein will have a minimum of 0.001 KNPU.

Another class of enzymes that can be used in the compositions of the present invention are the amylases which act to catalyze or accelerate the hydrolysis of starch. Amylases are used largely in the corn syrup industry for the production of glucose syrups, maltose syrups, and a variety of other more refined end products of starch hydrolysis such as high fructose syrups. As a class they include α-amylase, β-amylase, amyloglucosidase (glucoamylase), fungal amylase, and pullulanase. Commercial liquid enzymatic compositions containing amylases are available under the names BAN, Termamyl™, AMG, Fungamyl™, and Promozyme™, which are supplied by Novo Nordisk, and Diazyme L-200, a product of Solvay Enzyme Products, Purastar ST L and Purastar HPAm L supplied by Genencor International Inc.

Other valuable enzyme which are useful in the present invention are those which affect the hydrolysis of fiber. These classes include cellulases, hemicellulases, pectinases, and β-glucanases. Cellulases are enzymes that degrade cellulose, a linear glucose polymer occurring in the cell walls of plants. Hemicellulases are involved in the hydrolysis of hemicellulose which, like cellulose, is a polysaccharide found in plants. The pectinases are enzymes involved in the degradation of pectin, a carbohydrate whose main component is a sugar acid. β-glucanases are enzymes involved in the hydrolysis of β-glucans which are also similar to cellulose in that they are linear polymers of glucose. In a commercial context, these enzymes have utility to a greater or lesser degree in manufacturing processes dependent on fiber degradation. Cellulases have reported utility in the de-inking process of old newsprint (ONP) wastepaper, eliminating the need for any surfactants and alkaline chemicals. The enzymes dislodge inks from fiber surfaces and disperse ink particles to a finite size. Collectively, cellulases include endocellulase, exocellulase, exocello-biohydrolase, and celloblase. Commercial liquid enzymatic compositions containing cellulases are available under the names Celluclast™ and Novozym™188 which are both supplied by Novo Nordisk.

Additional enzymes that can be utilized also include the pectinases which are used commercially to weaken cell walls and enhance extraction of fruit juice, as well as to aid in decreasing viscosity and preventing gelation in these extracts. Pectinases consist of endopolygalacturonase, exopolygalacturonase, endopectate lyase (transeliminase), exopectate lyase (transeliminase), and endopectin lyase (transeliminase).

Another important classes of useful enzymes for practicing the invention enzymes are the lipases and phospholipases. Lipases and phospholipases are esterase enzymes which hydrolyze fats and oils by attacking the ester bonds in these compounds. Lipases act on triglycerides, while phospholipases act on phospholipids. In the industrial sector, lipases and phospholipases represent the commercially available esterases, and both currently have a number of industrial and commercial applications. In the pulp and paper industry, liquid enzyme preparations containing lipases have proven to be particularly useful in reducing pitch deposits on rolls and other equipment during the production process. Another important use of lipases is to degrease hides and pelts in the leathermaking process. Alkaline lipases are used in conjunction with special proteases and emulsifying systems to aid degreasing, as well as to improve the soaking and liming effect in leathermaking. Lipases have also been used for the development of flavors in cheese and to improve the palatability of beef tallow to dogs. In nonaqueous systems, lipases have been employed to synthesize esters from carboxylic acids and alcohols.

The preferred compositions of the present invention also include one or more viable microorganisms, or mixtures thereof, capable of surviving in the intended environment, and having the ability of degrading or promoting degradation of oils, hydrocarbons and other waste materials that may adhere to industrial equipment when in use. The present invention utilizes organisms which include strains of Bacillus, Pseudomonas, Arthrobacter, Enterobacter, Citrobacter and Corynebacter. Bacillus genus is preferred because it not only has excellent hydrocarbon waste degrading abilities but also produces a protected spore form. A preferred viable microorganism contains components including two strains of *Bacillus subtilis* and strains of Pseudomonas specifically adapted for high production of extracellular enzymes, particularly proteases, amylases, and cellulases. Such strains are common in waste treatment products. The second viable micoroganism contains four strains of Bacillus specifically adapted for high production of extracellular enzymes, particularly proteases,amylases, cellulases and lipases. Bacteria is both anerobic and aerobic so that it will propagate withour and with air in its environment.

It should be understood that bacteria of suitable microbial strains generally *Bacillus subtilis* may be specifically developed for the degradation of waste. Benefits include grease removal from manufacturing equipment and collection systems as well as improved degradation in treatment systems including but not limited to systems where petroleum and related products are used. The compositions of the present invention may be maintained at a pH of from about 5.5 to about 13.5, more preferably at a pH of from about 9–11 and most preferably at a pH of from about 12–14 in order to insure proper conditions for bacteria to germinate and actively degrade organics. The preferred pH activity range for the composition of the present invention is between about 12 and 13.5.

It should be noted that Bacteria reproduce about every 20 minutes when given the right environment to sustain growth. Prior art has defined this environment as a water based system (providing oxygen) having pH of 7.0 with nutrients such as nitrogen and phosphate. This invention promotes microbial growth outside of this environment where typically enzymes are deactivated and microbes expire.

The bacteria have a preservative system to prevent contamination by outside vegetative organisms.

A suitable concentration level of viable microorganisms is about $1.0\times10^7$/ml., however, much lower concentrations could be effective in improving the cleaning treatment depending on the type of system to which it was introduced and amount of material used in cleaning. An operable concentration range for the microorganisms is from about $1\times10^6$/ml to $1\times10^9$/ml. A preferred concentration is about $\geqq3\times10^6$. Commercial of the shelf products containing viable microroganisms which are useful for making the compositions of the present invention include EcoSolve 2000 with microbial cultures which degrade hydrocarbons supplied by Market America Inc., (7605-A Business Park Drive, Greensboro, N.C. 27409), and WD-10P supplied by Bio-Catalytic Enterprises, Inc. (1175 Post Road East, Westport, Conn. 06800.)

Another important component of the composition of the present invention is a surfactant. The surfactant may be selected from the group consisiting of anionic, nonionic, cationic, ampholytic and amphoteric surfactants with the nonionic surfactants being preferred. Numerous nonionic surfactants are within the scope of the present invention. Such surfactants include, but are not limited to, alkyl aryl polyether alcohols having degrees of ethoxylation from 1.5 to 120, including but not limited to, alkyl phenol ethoxylates having an alkyl chain length of between about 6 and 18 carbons, such as nonylphenol ethoxylates, octylphenol ethoxylates and dodecylphenol ethoxylates; alkyl polyether alcohols having degrees of ethoxylation from 1.5 to 120, including but not limited to, linear polyether alcohols having an alkyl chain length from between about 4 and 22 carbons, mixed linear alcohol ethoxylates, secondary alcohol ethoxylates having an alkyl chain length from between about 6 and 22 carbons, branched alkyl alcohol ethoxylates having between about 8 and 22 carbons, such as tridecylalcohol ethoxylates, trimethylnonanyl ethoxylates, and isodecyl alcohol ethoxylates, isotridecyl alcohol ethoxylates; nonionic amides such as alkanolamides, including but not limited to, 1:1 diethanolamides, monoethanol amides, monoisopropanolamides, 2:1 alkanolamides and modifications thereof, ethoxylated alkanolamides, and bisamides; nonionic esters, including but not limited to, alcohol, glycerol, and glycol esters, polyethylene glycol (PEG) esters such as diethylene glycol monostearates, glycerol monostearate, PEG laurates, PEG dilaurates, PEG monooleates, and PEG dioleates, where PEG has a molecular weight ranging between about 100 and 1000; ethoxylated acids and oils, including derivatives of castor oil, oleic acid, linoleic acid, myristic acid, lauric acid, and stearic acid, among others, where the organic acids have from between about 6 to 20 carbons having linear and branched chain structures, and degrees of ethoxylation from 1.5 to 200; sorbitan esters and ethoxylated sorbitol esters, including but not limited to sorbitan monolaurate, ethoxylated sorbitan inonolaurate, sorbitan monooleate, ethoxylated sorbitan monooleate, sorbitan trioleate and ethoxylated sorbitan trioleate, where the polyhydric alcohols and sugars have a degree of ester substitution of between about 1 and 4, and degrees of ethoxylation from between about 0 to 200; alkyl polyglucoside surfactants having between about 1 and 10 saccharide units and alkyl substitution from between about 0.5 and 2.5; ethoxylated mercaptans having an alkyl chain length from between about 6 and 18 carbons and a degree of ethoxylation from between about 4 and 20; low foaming surfactants, including ethylene oxide/propylene oxide (EO/PO) block copolymers such as the Pluronic® and Tetronic® products available from BASF Corporation, Parsippany, N.J., linear alcohol EO/PO, branched alcohol EO/PO, aryl alkaryl EO/PO, and linear alcohol EO with a chlorine cap; ethylene oxide/propylene oxide copolymers, including both block and random copolymers, having a molecular weight from between about 1000 and 25,000 and cloud point from 10 C. to greater than 100 C.; and amine ethoxylates having a degree of ethoxylation from 1.5 to 75 and alkyl groups having from between about 4 to 22 carbons. The composition of the present invention does not encompass use of amine oxides as the nonionic surfactants.

Any combination of the above nonionic surfactants can also be used, provided no problems arise with the compatibility of the surfactants. Compatibalizing agents, such as hydrotropes, can be used with these surfactants as required.

Preferred nonionic surfactants for use in the compositions and methods of the present invention are hard surface cleaning and low foaming surfactants, such as the alkyl aryl polyether alcohols, alkyl polyether alcohols, ethoxylated mercaptans and low foaming sufactants described above.

In addition, one or more of the above nonionic surfactants can be mixed with one or more anionic surfactants. Suitable anionic surfactants include, but are not limited to, alkyl sulfates, alkyl ether sulfates, alkyl sulfonates, alkylaryl sulfonates, sulfosuccinates, phosphate esters, carboxylates, saponified organic soaps, alkyl isethionates, amine ethoxy sulfates and alkyl phenolethoxy sulfates. Of the various anionic surfactants mentioned, the preferred salts are sodium salts and the higher alkyls are of 10 to 18 carbon atoms, preferably of 12 to 18 carbon atoms. Specific exemplifications of such compounds include: sodium linear tridecyl benzene sulfonate; sodium linear pentadecyl benzene sulfonate; sodium p-n-dodecyl benzene sulfonate; sodium lauryl sulfate; potassium coconut oil fatty acids monoglyceride sulfate; sodium dodecyl sulfonate; sodium nonyl phenoxy polyethoxy ethanol (of 30 ethoxy groups per mole); sodium propylene tetramer benzene sulfonate; sodium hydroxy-n-pentadecyl sulfonate; sodium dodecenyl sulfonate; lauryl polyethoxy ethanol sulfate (of 15 ethoxy groups per mole); and potassium methoxy-n-tetradecyl sulfate.

Ampholytic synthetic surfactants that are suitable for use in the present invention are derivatives of aliphatic secondary and tertiary amines, in which the aliphatic radical may be straight chain or branched and wherein one of the aliphatic substituents contains from about 8 to about 18 carbons and one contains an anionic water solubilizing group, i.e., carboxy, sulfo, sulfato, phosphato or phosphono. Examples of compounds falling within this definition are sodium 3-dodecylamino proprionate and sodium 2-dodecylamino propane sulfonate.

Amphoteric surfactants which are applicable to the present invention include derivatives of aliphatic quaternary ammonium, phosphonium and sulfonium compounds in which the aliphatic radical may be straight chained or branched, and wherein one of the aliphatic substituents contains from about 8 to 18 carbon atoms and one contains an anionic water solubilizing group, e.g., carboxy, sulfo, sulfato, phosphato or phosphono. These compounds are frequently referred to as betaines. Besides alkyl betaines, alkylamino- and alkylamide-betaines are encompassed within this invention.

When using both nonionic and anionic surfactants, any ratio of nonionic to anionic surfactant within the range of 15:1 to 1:3 can be used, with a ratio of between 5:1 and 1:1 being preferred. When using a mixture of nonionic and anionic surfactants, an excess of nonionic surfactant is preferred, and if using excess anionic surfactant, an anionic to nonionic surfactant ratio of 2:1 should not be exceeded. This is to prevent destabilization of the enzyme, such as that caused by anionic surfactants. Formulations containing only nonionic surfactants are most preferable over nonionic/anionic surfactant combinations.

The composition should contain at least 0.5% of total surfactant, including both nonionic surfactant and anionic surfactant, if used. More preferably, the amount of total surfactant will be in the range of 1.0 and 10%, although amounts up to 25% or higher can be used.

The compositions of the invention also include an alkali metal silicate. The alkali metal silicate is, for example, sodium silicate having $SiO_2$:$Na_2O$ ratios from 3.25 to 1.6 (commercially available from The PQ Corporation, Valley Forge, Pa. 19482), or potassium silicate having $SiO_2$: K.sub.2 O ratios of 1.60 to 2.50 (commercially available from The PQ Corporation as KASIL™ or KASOLV™), or mixtures thereof. The alkali metal silicate is preferably sodium metasilicate or in the alternative potassium silicate and especially KASIL™ #6 2.5 ratio $SiO_2$:$K_2O$. Other commercial products which are off the shelf products incorporating sodium metasilicate and which are useful in making the compositions of the invention is "BLISTER" supplied by Hy Speed Cleaning Products Inc (Castle Haynes, N.C.). The poduct is dsecribed as containing 3–5% sodium metasilicate, 80–90% water, 3–5% 2-butoxyethanol, 1–3% surfactant and 0–1% potassium hydroxide.

The surfactant mixture which is added to the formulation of the invention can be a premix such as a mixture of polyethylene oxide (9) of nonylphenol at levels of 0.02 to 0.53% by weight; sodium metasilicate at levels of 0.50–1.18 wt %; monoethanolamine at levels of 0.65% vol/vol; propylene glycol-N-butyl ether at levels of 0.05–0.15 wt % or 1095 mg/L; polyethylene oxide (9) of decyl ether at levels of 0.25–0.53 wt % and ethylene glycol—N-butyl ether at levels of 2.0–3.7 wt %.

The inventive composition also includes commercial off-the shelf compositions incorporating surfactants and alkaline metal hydroxides. One commercial product that is useful in making the compositions of the invention is a product identified as "Spartan Oven and Grill Cleaner" sold by Spartan Chemical Company, Maumee, O.H. and having a pH of 13.9. The other product is a SNAP H/D concentrate sold by Market America, Greensboro, N.C. The Spartan and Snap products are particularly useful in making the compositions of the invention.

The compositions of the invention also include a carrier or solvent such as water. The water may be tap water, deionized water or distilled water. Co-solvents such as propylene glycol, 2-butoxyethanol and dipropylene glycol may also be added to the composition to enhance solubility as well as stability. Other co-solvents as long as they are fully miscible with water may be used. The co-solvents also enhance cleaning by dissolving the fats and greases and aiding penetration into the baked-on grease and or other soil film deposits. Included among the solvents are a wide range of water soluble or dispersible compounds. Further solvents can be chosen from monohydric alcohols, polyhydric alcohols such as the alkylene glycols, alkylene glycol ethers, ketones and esters. Alkylene glycol derived ethers are especially preferred. Among the solvents are included diethylene glycol diethyl ether (diethyl Carbitol), diethylene glycol monoethyl ether (Carbitol), diethylene glycol monobutyl ether (butyl Carbitol) and ethylene glycol monobutyl ether (butyl Cellosolve). N-Methyl-2-pyrrolidone, sold by the GAF Corporation under the trademark M-Pyrol, is another preferred solvent.

The compositions also include miscellaneous ingredients which are commonly used in cleaning formulations such as fragrances, deodorizers, and coloring dyes.

A particularly preferred formulation of the invention comprises 10–35% by weight of the Blister product described above, 5–20% by weight of the SNAP H/D concentrate described above, 5–20% by weight of the Spartan Oven Cleaner, 5–20% by weight of EcoSolve 2000 with microbial cultures which includes about 20–60 grams fo freeze dried microbes (supplied by Market America), 5–20% by weight of WD-10P (supplied by Bio-Catalytic Enterprise, Inc) , 3–15% by weight (Alcalase) enzymatic liquid (sold by Novo Nordisk) and about 2–7% of a liquid fragrance.

The present invention also provides a method for cleaning industrial and domestic surfaces and articles, as hereinafter defined, which are contaminated with organic or lipophilic wastes, comprising applying to said industrial surfaces and domestic surfaces a cleaning composition having a pH in the range of about 5.5 to about 14, containing enzymes, viable microroganism and a surfactant.

The term industrial and domestic surfaces and articles as used herein is intended to include machined parts and machinery surfaces whether made of plastic, metal, alloys thereof or combinations thereof and inter alia includes electronic components, electrical parts and even circuit boards as well as including domestic surfaces and articles such as glassware, china and ceramic plates, flatware, cooking utensils, as well as household surfaces as exemplified in the examples hereinafter. Metallic surfaces include ferrous and non-ferrous surfaces. Ferrous surfaces include, but are not limited to, steel, cold-rolled steel, cast iron, tin-plated steels, copper-plated steels, organic-coated steels, galvanized steels and zinc/aluminum galvanized steels. Non-ferrous surfaces include, but are not limited to, aluminum and aluminum alloys, zinc and zinc-based alloys, zinc-aluminum alloys, and copper and copper alloys.

Plastic surfaces include but are not limited to, polycarbonates, polyvinyl chlorides, polyethylenes, polypropylenes, thermoplastic polyesters or polyamides, polyurethanes, epoxides or polyepoxies, polystyrene or its copolymers, nylons and modified polyamides, and modified celluloses.

It will be realised that in the context of the present invention the method herein described can be used for cleaning machines used for cutting, turning, grinding and milling in that by applying the compositions of the invention an easy and rapid cleaning of the machine surfaces from adhering greases, oils and fats which accumulate following operation of a such machine is achieved. It is also to be noted that the method of the present invention can be carried out in a wide range of operating temperatures, e.g., from temperatures close to 0 C. to those in the range of 76° C. since the compositions of the invention are stable and effective across this entire temperature range.

As further indicated in the examples of the present invention there is provided a method for cleaning domestic articles and surfaces comprising applying the compositions of the invention to remove wastes selected from oils, greases, food residues and carbonaceous combustion products.

Contacting the surface with the composition can be achieved by any means known in the art. Typical contacting methods include immersion or dipping the equipment or surface to be cleaned in a bath of the composition. All forms of immersion cleaning, such as typical immersion cleaning, ultrasonic cleaning and the like are contemplated by this invention. Alternatively, the composition can be sprayed onto the surface by any spray means known in the art, such as through use of cabinet washing or a conveyor system used with a spray chamber. The contact time between the surface to be cleaned and the composition should be at least 30 seconds, with 1–10 minutes being preferred. Longer contact times are also within the scope of the present invention. Following the contact period, the composition can either be removed from the surface, or the surface can be further treated. Removal of the composition from the surface can be effected by any means known in the art, such as through rinsing.

As will be appreciated by those skilled in the art, the contact time for the solution will vary depending upon various factors, such as the surface to be cleaned, the amount of contamination on the surface, the type of contamination of the surface and the type of configuration of the washing equipment. Adjustment of contact time to maximize the effects of the methods of the present invention are within the scope of one skilled in the art.

The present invention is illustrated by the following Examples, but should not be construed to be limited thereto. In the Examples, "part" and "%" are all part by weight or % by weight unless specified otherwise.

EXAMPLE I

The compositions of this invention are prepared by adding the components as shown below with stirring in a suitable mixer and homogenizer at a temperature of about 15° C. to about 50° C.

| COMPONENT | % BY WEIGHT |
|---|---|
| nonylphenoxy poly(ethyleneoxy) ethanol 15EO | 12% |
| Alcalase (40 gm/ltr water) | 10% |
| Sodium Silicate | 5% |
| Sodium Hydroxide | 5% |
| Microroganisms | $1 \times 10^8$/ml |
| Fragrance | 2% |
| Water | Balance |

EXAMPLE II

Using the procedure of Example I the following formulation was made:

| COMPONENT | % BY WEIGHT |
|---|---|
| nonylphenoxy poly(ethyleneoxy) ethanol 15EO | 12% |
| Savinase (40 gm/ltr water) | 10% |
| Sodium Silicate | 10% |
| Sodium Hydroxide | Added until pH 9.5 |
| Propylene glycol | 5% |
| Dipropylene glycol | 2% |

-continued

| COMPONENT | % BY WEIGHT |
|---|---|
| Microroganisms | $1 \times 10^9$/ml |
| Fragrance | 4% |
| Water | Balance |

EXAMPLE III

Using the procedure of Example I the following formulation was made:

| COMPONENT | % BY WEIGHT |
|---|---|
| nonylphenoxy poly(ethyleneoxy) ethanol 15EO | 12% |
| Savinase (40 gm/ltr water) | 5% |
| Alcalase (40 gm/ltr water) | 5% |
| Sodium Silicate | 10% |
| Sodium Hydroxide | Added until pH 9.5 |
| Microroganisms | $1 \times 10^9$/ml |
| Water | Balance |

EXAMPLE IV

Using the procedure of Example I the following formulation was made:

| COMPONENT | % BY WEIGHT |
|---|---|
| nonylphenoxy poly(ethyleneoxy) ethanol 15EO | 12% |
| Savinase (40 gm/ltr water) | 2.5% |
| Alcalase (40 gm/ltr water) | 5% |
| Lipase (40 gm/ltr water) | 2.5% |
| Sodium Silicate | 5% |
| Sodium Hydroxide | Added until pH 9.5 |
| Microroganisms | $1 \times 10^9$/ml |
| Water | Balance |

EXAMPLE V

Using the procedure of Example I the following formulation was made:

| COMPONENT | % BY WEIGHT |
|---|---|
| octylphenoxy poly(ethyleneoxy) ethanol 15EO | 12% |
| Savinase (40 gm/ltr water) | 2.5% |
| Alcalase (40 gm/ltr water) | 5% |
| Lipase (40 gm/ltr water) | 2.5% |
| Sodium Silicate | 5% |
| Sodium Hydroxide | Added until pH 11.5 |
| Microroganisms | $1 \times 10^9$/ml |
| Water | Balance |

EXAMPLE VI

Using the procedure of Example I the following formulation was made:

| COMPONENT | % BY WEIGHT |
|---|---|
| octylphenoxy poly(ethyleneoxy) ethanol 15EO | 12% |
| Alcalase (40 gm/ltr water) | 5% |
| Lipase (40 gm/ltr water) | 5% |
| Sodium Silicate | 5% |
| Sodium Hydroxide | Added until pH 12.5 |
| Microroganisms | $1 \times 10^9$/ml |
| Water | Balance |

EXAMPLE VII

Using the procedure of Example I the following formulation was made:

| COMPONENT | % BY WEIGHT |
|---|---|
| octylphenoxy poly(ethyleneoxy) ethanol 15EO | 12% |
| Alcalase (40 gm/ltr water) | 5% |
| Lipase (40 gm/ltr water) | 5% |
| Sodium Silicate | 5% |
| Sodium Hydroxide | Added until pH 13.5 |
| 2-Butoxyethanol | 5% |
| Microroganisms | $1 \times 10^9$/ml |
| Water | Balance |

EXAMPLE VIII

Using the procedure of Example I the following formulation was made:

| COMPONENT | % BY WEIGHT |
|---|---|
| octylphenoxy poly(ethyleneoxy) ethanol 15EO | 12% |
| Alcalase (40 gm/ltr water) | 5% |
| Savinase (40 gm/ltr water) | 2.5 |
| Lipase (40 gm/ltr water) | 2.5% |
| Sodium Silicate | 5% |
| Sodium Hydroxide | Added until pH 13.5 |
| Microroganisms | $1 \times 10^9$/ml |
| Propylene glycol | 7% |
| Water | Balance |

EXAMPLE IX

Using the procedure of Example I the following formulation was made:

| COMPONENT | % BY WEIGHT |
|---|---|
| Blister | 20% |
| Snap H/D Concentrate | 20% |
| Spartan Oven Cleaner | 10% |
| Ecosolve 2000 | 20% |
| WD-10p | 15% |
| Alcalase (40 gm/ltr water) | 10% |
| Microroganisms freeze dried | 30 grams |
| Fragrance | 5% |

EXAMPLES ILLUSTRATING THE INDUSTRIAL APPLICABILITY OF THE COMPOSITIONS OF THE INVENTION

EXAMPLE X

The composition of Example 1 was used to clean a truck whose engine had not been washed in about 3 years. The solution was sprayed on the engine and allowed to stay in contact with the engine for about 5 minutes, then took a water hose with a nozzle that sprayed with a little bit of pressure and washed the engine which after a final water rinse it looked completely brand new. This only took about 15 minutes.

EXAMPLE XI

The solution of Example I was used to clean concrete. The solution was put in a pump sprayer and then sprayed the area of concrete on both sides of the traffic island that needed to be clean and the cleaning solution was allow to soak for about 10–15 minutes. The cleaning solution was then rinsed-off with a cold water pressure washer with a 25 degree pressure nozzle to give a brand new appearance to the concrete.

EXAMPLE XII

The solution of Example I was used to clean gas nozzles which are covered with carbon deposits, petroleum, fuel, etc. Traditionally, these nozzles are cleaned by taking the mechanical parts out of them leaving only an aluminum shell and then soaking these shells in solvent in a 50 gallon container sitting on a rack for about an hour. Then they are taken outside to wash them off 3–4 times with a hot water pressure washer. The solution of Example I is put into an empty tank and then the nozzles are put in and left in the soaking solution for about 15 minutes which upon rinsing they came out looking as if they were new nozzles. During the cleaning of the nozzles it was determined that the enzyme activity is maintained, for as long as it is feeding, in the high pH level for a period of 8–10 weeks which saved the user a considerable amount of money.

EXAMPLE XIII

The solution of Example I was used to strip 25-years of wax build-up on a tile floor. The solution was put down on the floor by mopping it in and then mopped it right up. No stripper pad or a machine to retract this wax from the floor was necessary.

EXAMPLE XIV

Using the solution of Example I in a sonic cleaner inner working parts of gas nozzles were cleaned and excellent results were achieved.

EXAMPLE XV

The solution of Example I was used to clean 30-year-old carburetors which came out of two Chryslers which have never been cleaned. Applicant left one out and put one in the solution and let it sit for 15 minutes, brought it back out and washed it off. It came out completely clean to the point that the original labels on it were shiny as new.

EXAMPLE XVI

The solution of Example I was taken to a small country restaurant where a lady was having trouble with her drain backup through a grease trap. She was having to have the drain flushed out about once a month professionally. The trap was cleaned out using the product of Example I and she went 4 months without having to clean the trap which was basically cleaned out of habit by her. More solution was placed in the trap and she has now gone 6 months still without having to clean the trap.

EXAMPLE XVII

The solution of Example I was used in a small restaurant that needed to clean their hoods and ovens. The solution in concentrate form which is 13.1 pH level was put it in a spray bottle and sprayed it right on the hood, right on the stainless steel and it immediately melted away all of the grease build-up. They took the filters out of the hood and took outside to spray this solution on and washed those off with a hose and they came clean as easily.

EXAMPLE XVIII

Tests were performed on hot glass bottle molds at different temperatures. During the testing solution of Example I was applied at different temperatures using the solution with microbes/enzymes and without microbes/enzymes. After testing was completed, it was determined without question that the solution with the microbes/enzymes was the product that caused the cleaning process to remove the carbon/ dirt/ residue on the molds.

The solution of Example 1 was used on the molds of cast iron and bronze alloy. The observation was that the solution started working sooner with higher mold temperatures on the cast iron molds. The bronze alloy molds needed to be cooler for the solution to start working.

During the application of the solution to the molds at temperatures of 350° C., a chemical reaction took place causing the loosening of the carbon/dirt/residue. It appeared after the solution was applied and let set for 45 seconds to one minute, that by spraying water over the solution it caused further cleaning brightening the mold. By wiping down the mold with a towel all the carbon/dirt/ residue would come off.

EXAMPLE XIX

In a similar manner as illustrated in the above application Examples, the cleaning solution of the invention has also been tested at a service station whose tanks have a great deal of diesel distribution/build-up. The solution was sprayed on the pump itself and stood right there and watched the build-up run off but we still used a water hose to make sure all of it was washed away. No scrubbing was required.

The new cleaning solution is also used to clean lathe machines, concrete cleaning machines, and floor sweeping machines. The solution completely bleached one side of the concrete floor.

Other products which can be cleaned include the blue off of new tires, plastic "0" rings, rubber "0" rings, stainless steel threaded cables that have waste buildup, jewelry, faded paint surfaces, toilet bowls, dirty aprons, dirty bar towels, bathrooms, brass lamps, antique coins, swimming pools, brick, fiber optic cable, carpet cleaning, and electrical and computer parts. When tested on stainless steel, it has been noted that it cleans much more effectively than other products in that it does not leave a residue.

The compositions of the invention has been tested at a water treatment center against raw water. The product took out chlorite, carbon dioxide, manganese, and iron. Bioremediation of soil contamination can also be achieved with the compositions of the present invention. The compositions of the invention are also useful in ridding an area of fire ants, mosquitoes, flies. Other applications of the invention include fire retardancy for paint thinners, killing gypsy moths It will be apparent from the foregoing that many other variations and modifications may be made regarding the cleaning compositions described herein, without departing substantially from the essential features, concepts and spirit of the present invention. Accordingly, it should be clearly understood that the forms of the inventions described herein are exemplary only and are not intended as limitations on the scope of the present invention as defined in the appended claims.

What is claimed is:

1. A cleaning composition consisting essentially of:

(a) an enzyme in an amount effective to promote cleaning, said enzyme being selected from the group consisting of proteases, amylases, lipases, cellulases, and mixtures thereof;

(b) viable microorganisms in an amount effective to degrade and promote the degradation of organic materials wherein said viable microorganism includes at least one strain of Bacillus subtilis;

(c) a nonionic surfactant;

(d) 1 to 5% by weight sodium silicate;

(e) 1 to 7% by weight sodium hydroxide effective to achieve a pH of from 9.5 to about 13.5;

(f) 0–2% by weight of a fragrance; and (g) the balance being water; wherein said cleaning composition is non-corrosive and non-irritating while maintaining at least 95% enzymatic activity at a pH range of from 9.5 to about 13.5.

2. The composition of claim 1 in which the microorganisms are present in a concentration of about $1\times10^6$/ml to $1\times10^9$/ml.

3. The composition of claim 1 in which the pH of the composition is maintained in the range of about 11.0 to 12.5.

4. The composition of claim 1 in which the microorganism further includes at least one organism from the group consisting of Pseudonmonas, Arthrobacter, Enterobacter, Citrobacter, and Corynebacter.

* * * * *